US006382624B1

(12) United States Patent
Kelm et al.

(10) Patent No.: US 6,382,624 B1
(45) Date of Patent: May 7, 2002

(54) APPARATUS FOR TRANSMITTING A TORQUE AND SHEET-PROCESSING PRINTING MACHINE

(75) Inventors: Carsten Kelm, Ketsch; Bernhard Buck, Heidelberg; Manfred Gross, Dossenheim, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/538,143

(22) Filed: Mar. 29, 2000

(30) Foreign Application Priority Data

Mar. 29, 1999 (DE) ..... 199 14 294

(51) Int. Cl.[7] ..... B65H 5/00

(52) U.S. Cl. ..... 271/264; 464/182; 464/183; 403/359.1

(58) Field of Search ..... 271/264, 314; 464/182, 183, 179; 403/359.1, 375, 359.5

(56) References Cited

U.S. PATENT DOCUMENTS 1,636,262 A * 7/1927 Troendly
2,976,702 A * 3/1961 Pietsch
5,842,415 A 12/1998 Maass

FOREIGN PATENT DOCUMENTS

DE 1 213 428 3/1966
EP 0 708 045 B1 4/1996

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

An apparatus for transmitting a torque from a drive shaft for a component of a printing machine to a hollow body surrounding the drive shaft, includes a coupling configuration. The coupling configuration is formed through the use of driver elements, engages in a longitudinally displaceable manner on the drive shaft and couples the latter to the hollow body. In order to use such an apparatus for torques which are not constant, according to a first variant, the coupling configuration includes a coupling ring surrounding the drive shaft, a first subgroup of driver elements coupling the drive shaft to the coupling ring, and a second subgroup of driver elements coupling the coupling ring to the hollow body. According to a second variant, the driver elements couple the drive shaft directly to the hollow body and are resilient in an at least substantially radial direction and in the circumferential direction of the drive shaft, relative to an axis of rotation of the drive shaft. A sheet-processing printing machine is also provided.

6 Claims, 3 Drawing Sheets

APPARATUS FOR TRANSMITTING A TORQUE AND SHEET-PROCESSING PRINTING MACHINE

BACKGROUND OF THE INVENTION

Field of the Invention

The invention relates to an apparatus for transmitting a torque from a drive shaft for a component of a printing machine to a hollow body surrounding the drive shaft, including a coupling configuration formed through the use of driver elements, longitudinally displaceably engaging the drive shaft and coupling the latter to the hollow body. The invention also relates to a sheet-processing machine, in particular a printing machine, through which the sheets pass in a processing direction, including a number of components to be positioned by displacing the latter transversely to the processing direction and to be driven by a respective apparatus for transmitting a torque through the use of a drive shaft common to the components.

An apparatus of the above-described type is known, for example, from European Patent EP 0 708 045 B1. A drive shaft disclosed therein is used to drive a component which forms a side-pull device of a printing machine. The side-pull device can be adjusted transversely to the direction of passage of sheets passing through the printing machine in order to adjust its position in relation to the sheets. The pulling mechanism of the side-pull device is connected to the drive shaft by a coupling configuration. The coupling configuration includes a hollow body which surrounds the drive shaft and is in the form of a clamping ring with two driver elements, secured opposite one another thereon. The driver elements are in the form of sliding blocks which engage in mutually opposite longitudinal slots in the drive shaft and thus couple the latter to the clamping ring of the side-pull device, which can be adjusted in the longitudinal direction of the drive shaft. The sliding blocks and the longitudinal slots are thus dimensioned and disposed relative to one another in such a way that the sliding blocks engage in the drive shaft while leaving a radial clearance relative to the drive shaft and a clearance in the circumferential direction of the drive shaft.

In that case, a respective clearance has a magnitude permitting the drive shaft to be displaced eccentrically by a certain amount relative to the clamping ring. The known apparatus is therefore suitable for an application in which the drive shaft is not in alignment with a body of revolution that surrounds the latter and to which a torque is transmitted by the drive shaft, in particular when the torque is at a constant value during operation.

SUMMARY OF THE INVENTION

It is accordingly an object of the invention to provide an apparatus for transmitting a torque and a sheet-processing printing machine, which overcome the hereinaforementioned disadvantages of the heretofore-known devices of this general type and which are configured in such a way that their area of application can be extended to cases where the torque to be transmitted is not constant during operation, i.e. to cases where rotating and/or circulating elements of a component, in particular a printing machine, may at times circulate at constant speed but are always subject to accelerations and decelerations.

With the foregoing and other objects in view there is provided, in accordance with the invention, an apparatus for transmitting a torque from a drive shaft for a component of a printing machine to a hollow body surrounding the drive shaft, comprising a coupling configuration, the coupling configuration having driver elements, longitudinally displaceably engaging the drive shaft and coupling the drive shaft to the hollow body, and the coupling configuration having a coupling ring surrounding the drive shaft; the driver elements divided into a first subgroup and a second subgroup; the first subgroup of driver elements coupling the drive shaft to the coupling ring for displacing the drive shaft eccentrically relative to the coupling ring in and counter to a first direction; and the second subgroup of driver elements coupling the coupling ring to the hollow body for displacing the coupling ring eccentrically relative to the hollow body in and counter to a second direction perpendicular to the first direction.

With the objects of the invention in view, there is also provided an apparatus for transmitting a torque from a drive shaft for a component of a printing machine to a hollow body surrounding the drive shaft, the drive shaft having a circumferential direction and an axis of rotation, comprising a coupling configuration having driver elements, longitudinally displaceably engaging the drive shaft and coupling the drive shaft to the hollow body; the driver elements coupling the drive shaft directly to the hollow body, and the driver elements constructed to be resilient in an at least substantially radial direction and in the circumferential direction of the drive shaft, relative to the axis of rotation of the drive shaft.

Through the use of an apparatus constructed in accordance with the invention, shocks which can occur in the known apparatus described above when the torque to be transmitted changes in the course of operation of the apparatus due to acceleration and deceleration phases, are avoided in particular. The reason for this is that the driver elements can be fitted in without leaving a clearance in the circumferential direction. The apparatus according to the invention can be used in an advantageous manner particularly for those components of a printing machine which can be adjusted to different working positions along a drive shaft common to the components and, for this purpose, are connected to a straight-line guide device which does not make use of the drive shaft. With this configuration, shock-free torque transmission is possible even in the case of a drive shaft which is relatively long and may be bent under its own weight.

In accordance with another feature of the invention, the driver elements have a rigid construction. In accordance with a further feature of the invention, the driver elements are formed integrally on the coupling ring. In both cases, the result is also, in particular, in-phase rotary motion of the drive shaft and the hollow body.

In accordance with an added feature of the invention, the first subgroup of driver elements has a rigid construction and the second subgroup of driver elements is constructed to be resilient relative to the coupling ring in an at least substantially radial direction. In accordance with an additional feature of the invention, the second subgroup of driver elements is also constructed to be resilient in the tangential direction as well.

With the objects of the invention in view, there is additionally provided a sheet-processing printing machine, comprising a number of components to be positioned by displacing the components, the components each having a hollow body; a drive shaft common to the components and surrounded by the hollow body of each of the components; and a number of apparatuses for driving the components and transmitting a torque from the drive shaft to the hollow body of each of the components, each of the apparatuses having a coupling configuration as described above.

Other features which are considered as characteristic for the invention are set forth in the appended claims.

Although the invention is illustrated and described herein as embodied in an apparatus for transmitting a torque and a sheet-processing printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

It is initially noted that components which are provided in a sheet-processing machine, in particular a printing machine, and have rotating and circulating elements that, on one hand, may circulate at constant speed at times and, on the other hand, are subject to accelerations and decelerations, are formed, in particular, by braking modules. Through the use of such braking modules, sheets passing through the machine at a processing speed are braked to a deposition speed which allows the formation of stacks from the processed sheets. The following explanation is therefore based, by way of example, on a sheet-processing printing machine.

Figure 1:
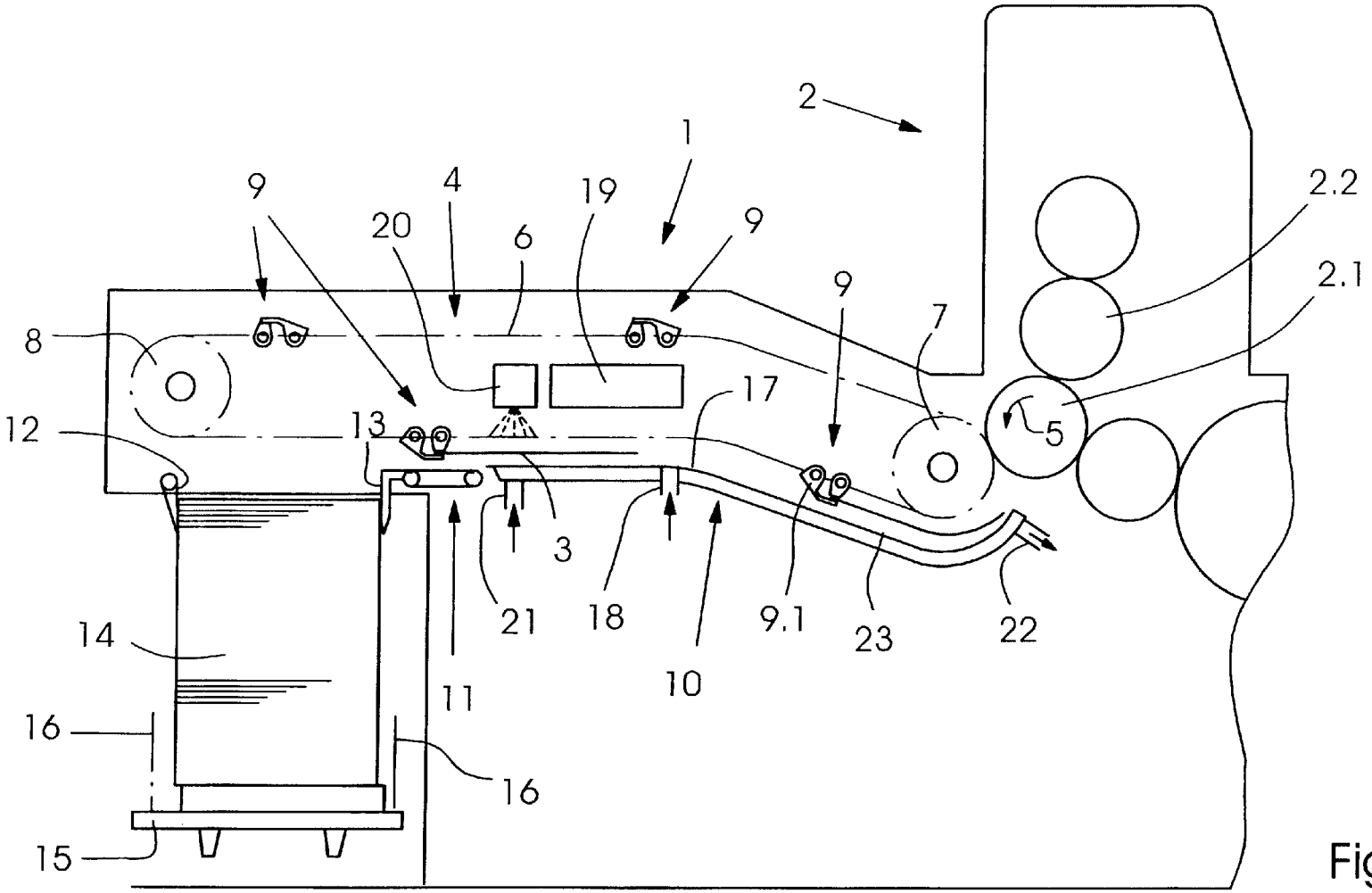
FIG. 1 is a fragmentary, diagrammatic, side-elevational view of a section of a sheet-processing printing machine, wherein the section includes a delivery.

Referring now to the figures of the drawings in detail and first, particularly, to FIG. 1 thereof, there is seen a section of a sheet-processing rotary printing machine. The section of the machine includes a delivery 1 and the delivery follows a final processing station. A processing station of this kind can be a printing unit or a post-treatment unit, such as a varnishing unit. In the present example, the final processing station is an offset printing unit 2 with an impression cylinder 2.1. The impression cylinder 2.1 guides a respective sheet 3 in a processing direction indicated through the use of a direction-of-rotation arrow 5. The impression cylinder 2.1 guides the sheet 3 through a press nip between the impression cylinder 2.1 and a blanket cylinder 2.2 cooperating with the latter, and then transfers the sheet to a chain conveyor 4. During that process grippers disposed on the impression cylinder 2.1 and provided for gripping the sheet 3 at a gripper edge at the leading end of the sheet are open. The chain conveyor 4 includes two conveyor chains 6, each one of which, when operating, circulates along a respective side wall of the chain delivery 1. Each conveyor chain 6 is wrapped around one of two synchronously driven drive sprockets 7, having axes of rotation which are aligned with each other. In the present example, each conveyor chain 6 is guided over a respective turn sprocket 8 located downstream of the drive sprockets 7 in the processing direction. Gripper systems 9 which extend between the two conveyor chains 6 are carried by the conveyor chains and have grippers 9.1 that move through gaps between the grippers disposed on the impression cylinder 2.1. In so doing, the grippers 9.1 take over a respective sheet 3, gripping the above-mentioned gripper edge at the leading end of the sheet 3 immediately before opening of the grippers disposed on the impression cylinder 2.1. The grippers 9.1 transport the sheet over a sheet guide device 10 to a sheet brake 11 and, at that point, open to transfer the sheet 3 to the sheet brake 11.

The sheet brake 11 imparts a deposition speed to the sheets which is reduced in comparison with the processing speed and, after reaching that deposition speed, in turn releases the sheets. Therefore, a respective sheet 3 which has now been slowed down finally strikes leading-edge stops 12 and, while being aligned with the latter and with trailing-edge stops 13 located opposite them, forms a stack 14 together with preceding and/or subsequent sheets 3. The stack 14 can be lowered through the use of a lifting mechanism to the extent to which the stack 14 grows. The only parts of the lifting mechanism which are illustrated in FIG. 1 are a platform 15 carrying the stack 14 and lifting chains 16, indicated in dot-dash lines, which carry the platform 15.

The conveyor chains 6 are guided along their paths between the drive sprockets 7, on one hand, and the turn sprockets 8, on the other hand, through the use of chain guide rails, which thus determine chain tracks of chain runs. In the present example, the sheets 3 are transported by a lower chain run in FIG. 1. That section of the chain track through which this run passes is followed by a sheet guide surface 17 that faces it and is formed on the sheet guide device 10. During operation, a carrying-air cushion is preferably formed between the sheet guide surface and the sheet 3 that is respectively guided over it. To that end, the sheet guide device 10 is equipped with blown-air nozzles which open into the sheet guide surface 17. Only one of the nozzles is shown in FIG. 1 but is representative of all of them and is illustrated in a symbolic representation in the form of a stub 18.

In order to prevent the printed sheets 3 in the stack 14 from sticking to one another, a dryer 19 and a dusting device 20 are provided on the path of the sheets 3 from the drive sprockets 7 to the sheet brake 11.

In order to avoid excessive heating of the sheet guide surface 17 by the dryer 19, a coolant circuit is integrated into the sheet guide device 10 and is indicated symbolically in FIG. 1 by an inlet stub 21 and an outlet stub 22 on a coolant trough 23 associated with the sheet guide device 17.

Figure 2:
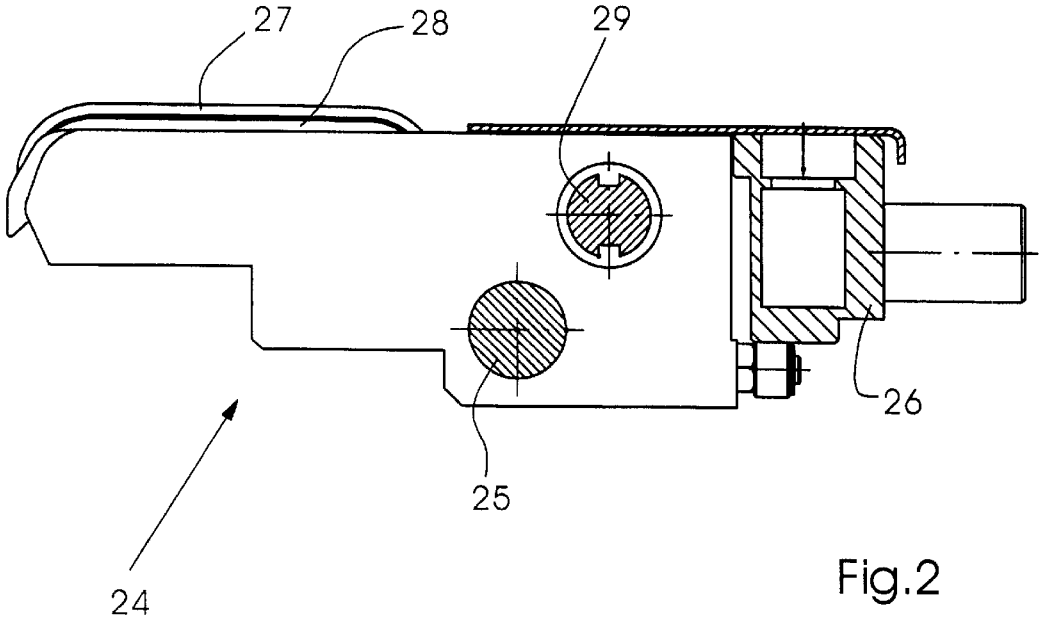
FIG. 2 is a simplified, partly sectional, side-elevational view of one of a number of braking modules guided along a transverse guide member, together with a drive shaft common to the modules.

FIG. 2 illustrates one of a plurality of braking modules 24. The braking modules 24 can be displaced along a straight-line guide device, which in this case is a guide bar 25 and a cross member 26, in order to set particular positions. The grippers 9.1 of a respective gripper system seen in FIG. 1 transfer a respective sheet 3 to a brake band 27 which is part of the braking modules 24 and which circulates during operation. The brake band 27 has non-illustrated apertures and is guided over a suction table 28, which is connected to a non-illustrated vacuum generator and has at least one non-illustrated suction opening facing the brake band 27.

In a configuration of the sheet brake 11 which is provided in this case by way of example, the respective brake band 27 circulates at the speed of the circulating gripper systems 9 during the transfer of a respective sheet 3 thereto. Once a respective sheet 3 has been released by a gripper system 9, the respective brake band 27 and therefore a sheet 3 to which it is applying suction is braked to the deposition speed and finally released by the braking modules 24 for stack formation.

The brake bands 27 of all of the braking modules 24 are driven by a drive shaft 29 which is common to them. The torque of the drive shaft 29 is transmitted to a hollow body surrounding the drive shaft 29 by a respective coupling configuration provided in the braking modules 24.

Figure 3:
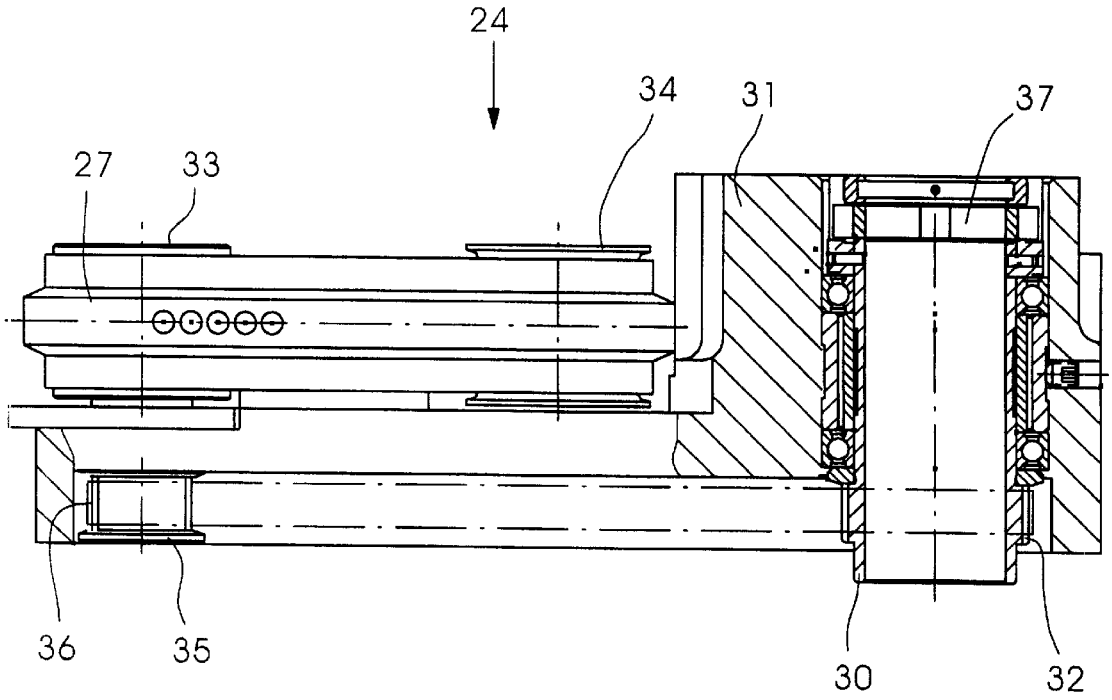
FIG. 3 is a simplified, partly broken-away, plan view of the braking module according to FIG. 2.

According to FIG. 3, such a hollow body 30 is constructed as a sleeve which is rotatably mounted in a main body 31 of the braking module 24 and is provided with an external ring gear 32. The brake band 27 is wrapped around a drive pulley 33 mounted in the main body 31 and around a turn pulley 34, likewise mounted in the main body 31. The drive pulley 33 is connected in a rotationally fixed manner to a pinion 35, around which a toothed belt 36 is wrapped. The toothed belt 36 is also wrapped around the external ring gear 32.

The drive shaft 29 (which is not illustrated in FIG. 3) passes through the hollow body 30 and is coupled to it through the use of the coupling configuration.

Figure 4:
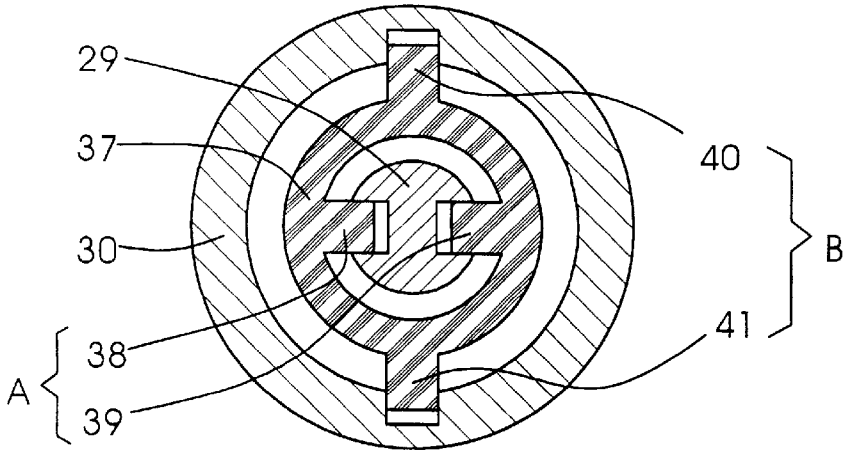
FIG. 4 is a cross-sectional view of one embodiment of the drive shaft and its coupling to a hollow body which can be driven through the use of the drive shaft, in accordance with an embodiment of a coupling configuration including a coupling ring and rigid driver elements.

In a preferred configuration illustrated in FIG. 4, this coupling configuration includes not only driver elements 38 to 41 but also a coupling ring 37 which surrounds the drive shaft 29. In the exemplary embodiment according to FIG. 3, the coupling configuration is secured against axial displacement relative to the hollow body 30 between an axial contact surface formed on the hollow body 30 and an adjusting ring secured on the hollow body 30. The driver elements are divided into a first subgroup A and a second subgroup B. In the present example, the first subgroup A includes the driver elements 38 and 39 and the second subgroup B includes the driver elements 40 and 41. The first subgroup A couples the drive shaft 29 to the coupling ring 37, and the second subgroup B couples the coupling ring 37 to the hollow body 30.

In the preferred configuration illustrated in FIG. 4, the drive shaft 29 is furthermore coupled to the coupling ring 37 in such a way that it can be displaced eccentrically relative to the coupling ring 37 in and counter to a first direction. The coupling ring 37, for its part, is coupled to the hollow body 30 in such a way that it can be displaced eccentrically relative to it in and counter to a second direction that is perpendicular to the first direction. In the case of the configuration according to FIG. 4, this is achieved through the use of the rigid driver elements 38 to 41, which are furthermore formed integrally on the coupling ring 37. The integral construction of the coupling ring 37 and the driver elements 38 to 41 which is thereby obtained proves advantageous particularly with regard to the structural configuration of the coupling configuration and its manufacturing costs. However, the functional requirements are also met by a configuration (not shown in the drawings) in which the integrally formed driver elements 38 to 41 are replaced by sliding blocks that act in the manner of keys. However, these sliding blocks then require more slots than is necessary for the integral construction and may require additional measures to secure the sliding blocks axially relative to the drive shaft 29.

The coupling of the drive shaft 29 to the coupling ring 37 in a manner which allows it to be displaced eccentrically relative to the coupling ring 37 in and counter to a first direction is achieved by virtue of the fact that the first subgroup A of driver elements 38 to 41 engages in a form-locking manner in longitudinal slots in the drive shaft 29 which are diametrically opposite one another. A form-locking connection is one which connects two elements together due to the shape of the elements themselves, as opposed to a force-locking connection, which locks the elements together by force external to the elements. The extent of the driver elements 38 and 39 of the first subgroup A and of the longitudinal slots in the radial direction relative to the drive shaft 29 is configured in such a way that the drive shaft 29 can be displaced by a certain amount in the radial direction relative to the coupling ring 37, along a first diameter of the latter.

The coupling of the coupling ring 37 to the hollow body 30 in such a way that it can be displaced eccentrically relative to the hollow body in and counter to a second direction perpendicular to the first direction is achieved by virtue of the fact that the driver elements 40 and 41 of the second subgroup B are disposed on a second diameter of the coupling ring 37, that diameter being perpendicular to the first diameter, and engage in a form-locking manner in recesses in the hollow body 30 which are situated diametrically opposite one another. The extent of the driver elements 40 and 41 and the recesses in the hollow body 30 in the radial direction relative to the coupling ring 37 is configured in such a way that the coupling ring 37 can be displaced by a certain amount in the radial direction relative to the hollow body 30, along the second diameter. This means that the drive shaft can be displaced in any direction eccentrically relative to the hollow body 30.

Figure 5:
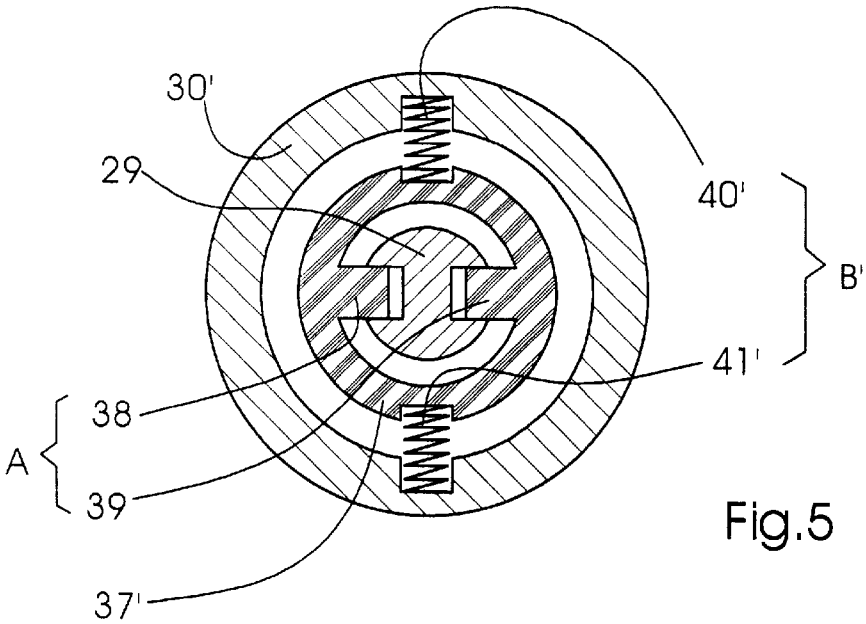
FIG. 5 is a view similar to FIG. 4 of an embodiment of a coupling configuration including a coupling ring and driver elements, some of which are rigid and some of which are resilient.

FIG. 5 shows a configuration which is modified in comparison with FIG. 4, in particular to the extent that the rigid driver elements 40 and 41 in FIG. 4 are replaced by driver elements 40' and 41' which form a second subgroup B' and are constructed in such a way as to be resilient relative to the coupling ring 37' in an at least substantially radial direction. In the present exemplary embodiment, these driver elements 40' and 41' are formed by helical springs. Each of the helical springs is supported, on one hand, on the coupling ring 37' and, on the other hand, on the hollow body 30' and, for this purpose, preferably engages, in each case in a form-locking manner, in respective pocket holes formed in the coupling ring 37', on one hand, and in the hollow body 30', on the other hand. In this case, the helical springs are dimensioned in such a way that they have adequate stiffness in a direction transverse to their longitudinal axis in order to enable them to transmit a required torque from the coupling ring 37' to the hollow body 30'. The helical springs allow resilient deflection not only in their longitudinal direction, in this case therefore radially relative to the coupling ring 37', but also tangentially to the coupling ring 37'. It is therefore possible to dispense with eccentric displaceability of the drive shaft 29 relative to the coupling ring 37' in and counter to one direction if the springs are used instead of the rigid driver elements 40 and 41. However, such displaceability can also be provided. In the embodiment illustrated in FIG. 5, this displaceability is allowed.

In the case of a resilient construction of the driver elements forming the second subgroup B' in the manner explained, there is moreover no restriction to the effect that this second subgroup B' has to have just two driver elements disposed opposite one another on a diameter of the coupling ring 37'. On the contrary, a second subgroup of more than two driver elements can be provided. That plurality of driver elements is then expediently disposed in a uniformly distributed manner over the circumference of the coupling ring 37'.

Particularly in this case, as in principle in the embodiment according to FIG. 5 as well, no gap is necessary between the coupling ring 37' and the drive shaft 29, and the first subgroup A of the driver elements can be formed by a single rigid driver element. In this case, a sliding fit, in particular, can also be provided between the drive shaft 29 and the coupling ring 37'.

However, it is expedient, specifically for use of the apparatus in a braking module 24 which has been explained, in view of the location of installation of the latter, that is in a delivery which is generally subjected to stray powder, to retain a gap between the drive shaft 29 and the coupling ring 37 or 37' in order to permit such a braking module 24 to be displaced easily in the longitudinal direction of the drive shaft 29.

Figure 6:
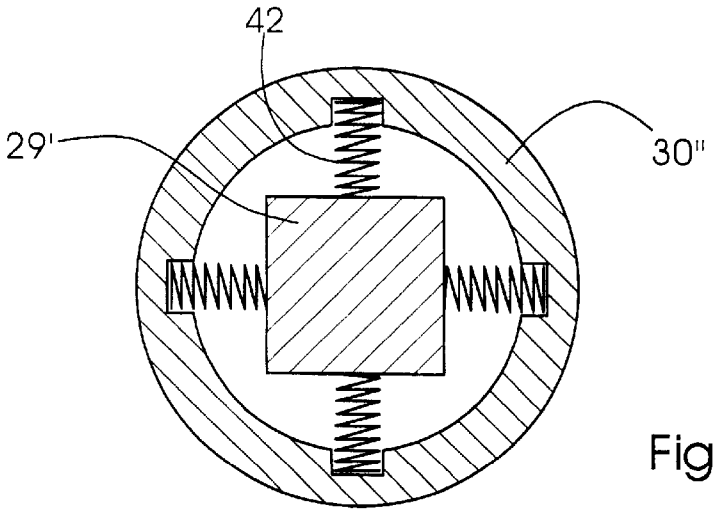
FIG. 6 is another view similar to FIG. 4 of a further embodiment of the drive shaft and its coupling to a hollow body which can be driven through the use of the drive shaft, in accordance with an embodiment of a coupling configuration including exclusively resilient driver elements.

FIG. 6 shows a configuration in which the coupling configuration does not have a coupling ring. The drive shaft 29', which in this case has a square cross section by way of example, is coupled directly to the hollow body 30" through the use of driver elements 42. The driver elements 42 are constructed to be resilient in an at least substantially radial direction and in the circumferential direction of the drive shaft 29', relative to the axis of rotation of the drive shaft 29'. For this purpose, in the present embodiment, the driver elements are formed by helical springs, each of which is supported, on one hand, on one longitudinal side of the drive shaft 29' and, on the other hand, in a pocket hole in the hollow body 30'. As in the case of the configuration according to FIG. 5, supporting the respective helical spring in a respective pocket hole in the hollow body 30" is one of the possibilities for torque transmission from the drive shaft 29' or 29 to the hollow body 30" or 30'. Another possibility, for example, is for radially inwardly-pointing pegs which each engage in an end portion of one of the helical springs to be disposed on the hollow body 30" or 30'. In the embodiment according to FIG. 6, each of the driver elements 42 is supported directly on one polygon surface of the drive shaft 29'. However, in another non-illustrated configuration, each of the driver elements 42 engages in a form-locking manner in a respective longitudinal slot in the drive shaft 29', as in the case of a drive shaft formed by a round profile.

In the embodiment according to FIG. 6, the drive shaft 29' is coupled directly to the hollow body 30" surrounding it through the use of the resilient driver elements 42 explained above, by distributing a plurality of such driver elements 42 over the circumference of the drive shaft 29'. However, just two such driver elements 42 are provided in the simplest case, and these are then disposed opposite one another on a diameter of the hollow body 30".

Irrespective of whether the apparatus explained thus far includes a coupling ring in accordance with a first concept or couples a drive shaft directly to a hollow body surrounding the drive shaft through the use of resilient driver elements in accordance with a second concept, the apparatus proves to be capable of integration into the braking modules in a particularly cost-saving and simple manner, to be economical in view of its simple construction and, by virtue of the clearances which can be achieved within the apparatus, to be insensitive to soiling such as that which can occur in a delivery of a sheet-processing printing machine in a powder-laden atmosphere, especially at the point of use of braking modules. With regard to simplicity of construction, it should also be pointed out that the coupling ring 37 or 37' provided in the first concept does not have to be provided with a fit either at its outer peripheral surface or its inner peripheral surface.

We claim:

1. In an apparatus for transmitting a torque from a drive shaft for a component of a printing machine to a hollow body surrounding the drive shaft, the improvement comprising:

a coupling configuration, said coupling configuration having driver elements, longitudinally displaceably engaging the drive shaft and coupling the drive shaft to the hollow body, and said coupling configuration having a coupling ring surrounding the drive shaft;

said driver elements divided into a first subgroup and a second subgroup;

said first subgroup of driver elements coupling the drive shaft to said coupling ring for displacing the drive shaft eccentrically relative to said coupling ring in and counter to a first direction; and said second subgroup of driver elements coupling said coupling ring to the hollow body for displacing said coupling ring eccentrically relative to the hollow body in and counter to a second direction perpendicular to said first direction.

2. The apparatus according to claim 1, wherein said driver elements have a rigid structure.

3. The apparatus according to claim 2, wherein said driver elements are formed integrally on said coupling ring.

4. The apparatus according to claim 1, wherein said first subgroup of driver elements has a rigid structure, and said second subgroup of driver elements is resilient relative to said coupling ring in an at least substantially radial direction.

5. The apparatus according to claim 4, wherein said second subgroup of driver elements is also resilient in tangential direction.

6. A sheet-processing printing machine, comprising:

a number of components to be positioned by displacing said components, said components each having a hollow body;

a drive shaft common to said components and surrounded by said hollow body of each of said components; and a number of apparatuses for driving said components and transmitting a torque from said drive shaft to said hollow body of each of said components, each of said apparatuses having a coupling configuration;

said coupling configuration having driver elements, longitudinally displaceably engaging said drive shaft and coupling said drive shaft to said hollow body, and said coupling configuration having a coupling ring surrounding said drive shaft;

said driver elements divided into a first subgroup and a second subgroup;

said first subgroup of driver elements coupling said drive shaft to said coupling ring for displacing said drive shaft eccentrically relative to said coupling ring in and counter to a first direction; and said second subgroup of driver elements coupling said coupling ring to said hollow body for displacing said coupling ring eccentrically relative to said hollow body in and counter to a second direction perpendicular to said first direction.

* * * * *